US008792308B2

(12) United States Patent
Kato et al.

(10) Patent No.: US 8,792,308 B2
(45) Date of Patent: Jul. 29, 2014

(54) RADIO-CONTROLLED WATCH

(75) Inventors: Akira Kato, Sayama (JP); Takushi Hagita, Tokorozawa (JP); Tadashi Yasuoka, Koto (JP)

(73) Assignees: Citizen Holdings Co., Ltd., Tokyo (JP); Citizen Watch Co., Ltd, Tokyo (JP)

( * ) Notice: Subject to any disclaimer, the term of this patent is extended or adjusted under 35 U.S.C. 154(b) by 22 days.

(21) Appl. No.: 13/634,403

(22) PCT Filed: Mar. 23, 2011

(86) PCT No.: PCT/JP2011/056982

§ 371 (c)(1),
(2), (4) Date: Sep. 12, 2012

(87) PCT Pub. No.: WO2011/118632

PCT Pub. Date: Sep. 29, 2011

(65) Prior Publication Data

US 2013/0003506 A1 Jan. 3, 2013

(30) Foreign Application Priority Data

Mar. 26, 2010 (JP) ..... 2010-073857

(51) Int. Cl.
*G04C 11/02* (2006.01)

(52) U.S. Cl.
USPC ..... 368/47

(58) Field of Classification Search
CPC ..... G04R 20/06; G05G 5/005; G04G 5/02; G04G 21/04; G04G 7/02; G04C 15/0054; G04C 13/445; G04C 15/0072; G04C 23/16; G04F 1/005; G04F 3/06; H04L 7/0008; H04L 7/02; H04L 7/0331
USPC ..... 368/47–48, 108; 375/354
See application file for complete search history.

(56) References Cited

U.S. PATENT DOCUMENTS

| | | | | |
|---|---|---|---|---|
| 7,057,976 | B2 * | 6/2006 | Berseth et al. | 368/10 |
| 7,948,833 | B2 * | 5/2011 | Ha et al. | 368/47 |
| 8,264,914 | B2 * | 9/2012 | Baba | 368/47 |

(Continued)

FOREIGN PATENT DOCUMENTS

| | | |
|---|---|---|
| JP | 2006-53143 A | 2/2006 |
| JP | 2008-145287 A | 6/2008 |

(Continued)

OTHER PUBLICATIONS

International Search Report for PCT/JP2011/056982 dated Apr. 26, 2011 English Translation.

(Continued)

*Primary Examiner* — Edwin A. Leon
(74) *Attorney, Agent, or Firm* — Sughrue Mion, PLLC

(57) ABSTRACT

Provided is a radio-controlled watch capable of performing leap second correction even when information on a leap second is not received from a satellite. Provided is a radio-controlled watch that adjusts time by receiving a signal containing time information from a satellite, the radio-controlled watch being configured to: store a leap second correction value to be used for leap second correction with respect to the time information; display a numerical value corresponding to the leap second correction value; receive an instruction operation of changing the leap second correction value from a user in a state in which the numerical value is displayed; and change the leap second correction value in response to the received instruction operation.

6 Claims, 10 Drawing Sheets

(56) References Cited

U.S. PATENT DOCUMENTS

| | | | | |
|---|---|---|---|---|
| 8,467,272 | B2 * | 6/2013 | Fujisawa | 368/47 |
| 2006/0034160 | A1 | 2/2006 | Berseth et al. | |
| 2008/0165628 | A1 | 7/2008 | Urano | |
| 2009/0180356 | A1 | 7/2009 | Fujisawa | |

FOREIGN PATENT DOCUMENTS

| | | | |
|---|---|---|---|
| JP | 2008-170229 | A | 7/2008 |
| JP | 2009-168620 | A | 7/2009 |
| JP | 2009-250801 | A | 10/2009 |

OTHER PUBLICATIONS

International Preliminary Report on Patentability issued in PCT/JP2011/056982 dated Nov. 1, 2012.

International Preliminary Report on Patentability and Written Opinion of the International Searching Authority corresponding to PCT/JP2011/056982, dated Nov. 1, 2012.

Office Action issued in corresponding Chinese Patent Application No. 201180046137.0 dated Oct. 28, 2013.

* cited by examiner

RADIO-CONTROLLED WATCH

TECHNICAL FIELD

The present invention relates to a radio-controlled watch that adjusts the time based on a signal received from a satellite.

CROSS REFERENCE TO RELATED APPLICATIONS

This application is a National Stage of International Application No. PCT/JP2011/056982 filed Mar. 23, 2011, claiming priority based on Japanese Patent Application No. 2010-073857 filed Mar. 26, 2010, the contents of all of which are incorporated herein by reference in their entirety.

BACKGROUND ART

There is known a radio-controlled watch that adjusts the time by receiving radio signal containing time information from an external time information supply source. As one type of such a radio-controlled watch, a study has been made on a radio-controlled watch that adjusts the time with the use of a signal received from a satellite, such as a Global Positioning System (GPS) satellite (see, for example, Patent Literatures 1 and 2).

CITATION LIST

Patent Literature

[Patent Literature 1] JP 2009-168620 A
[Patent Literature 2] JP 2008-145287 A

SUMMARY OF INVENTION

Technical Problem

In the above-mentioned radio-controlled watch, leap second correction is sometimes necessary in order to obtain the time under Coordinated Universal Time (UTC) from time information contained in a received signal. In the case where the signal transmitted by the satellite contains such information on the leap second, it is conceivable that the radio-controlled watch receives the information on the leap second to adjust the time information. However, in the case of a GPS satellite, for example, the information on the leap second is not transmitted as frequently as the time information, and hence the state of being unable to receive the information on the leap second may continue. Alternatively, it is also conceivable that the function for receiving the leap second information separately from the time information cannot be installed in the first place because of hardware restrictions or the like.

The present invention has been made in view of the above-mentioned problem, and therefore it is one object of the present invention to provide a radio-controlled watch capable of performing leap second correction even when information on the leap second is not received from a satellite.

Solution to Problem

According to the present invention, there is provided a radio-controlled watch that adjusts time by receiving a signal containing time information from a satellite, the radio-controlled watch including: storage means for storing a leap second correction value to be used for leap second correction with respect to the time information; leap second display means for displaying a numerical value corresponding to the leap second correction value stored in the storage means; instruction receiving means for receiving an instruction operation of changing the leap second correction value from a user in a state in which the leap second display means displays the numerical value; and leap second correction value changing means for changing the leap second correction value stored in the storage means in response to the received instruction operation.

Further, the storage means may further store information relating to an expiry date of the leap second correction value, the leap second correction value changing means may update the information relating to the expiry date when changing the leap second correction value, and the radio-controlled watch may further include determination result display means for determining, with use of the information relating to the expiry date, whether the leap second correction value stored in the storage means is valid or not, and displaying a result of the determination.

Further, in the above-mentioned radio-controlled watch, the instruction receiving means may receive the instruction operation from the user in a state in which the determination result display means displays that the leap second correction value stored in the storage means is not valid, and the instruction receiving means may restrict the reception of the instruction operation in a state in which the determination result display means displays that the leap second correction value stored in the storage means is valid.

Further, the signal from the satellite may contain information relating to the leap second correction value, the radio-controlled watch may further include leap second information receiving means for receiving the signal containing the information relating to the leap second correction value from the satellite, and changing the leap second correction value stored in the storage means in accordance with the received signal, and the leap second information receiving means may update the information relating to the expiry date when extracting the information relating to the leap second correction value.

Further, in the above-mentioned radio-controlled watch, the leap second display means may display the numerical value corresponding to the leap second correction value by a combination of a second hand and a minute hand.

Further, in the above-mentioned radio-controlled watch, the instruction receiving means may receive, from the user, the instruction operation of changing the leap second correction value and also an input operation of information indicating an application time of applying the changed leap second correction value, and the leap second correction value changing means may change the leap second correction value stored in the storage means at a time corresponding to the application time.

Further, in the above-mentioned radio-controlled watch, when it is determined that the leap second correction value stored in the storage means is valid, the determination result display means may display the expiry date together with the result of the determination.

Advantageous Effects of Invention

According to the radio-controlled watch of the present invention, it is possible to perform the leap second correction without receiving the information on the leap second from the satellite.

DESCRIPTION OF EMBODIMENTS

Hereinafter, embodiments of the present invention are described in detail with reference to the drawings. Note that the case where a radio-controlled watch according to the embodiments of the present invention is a wristwatch will be described below as an example.

First Embodiment

Figure 1:
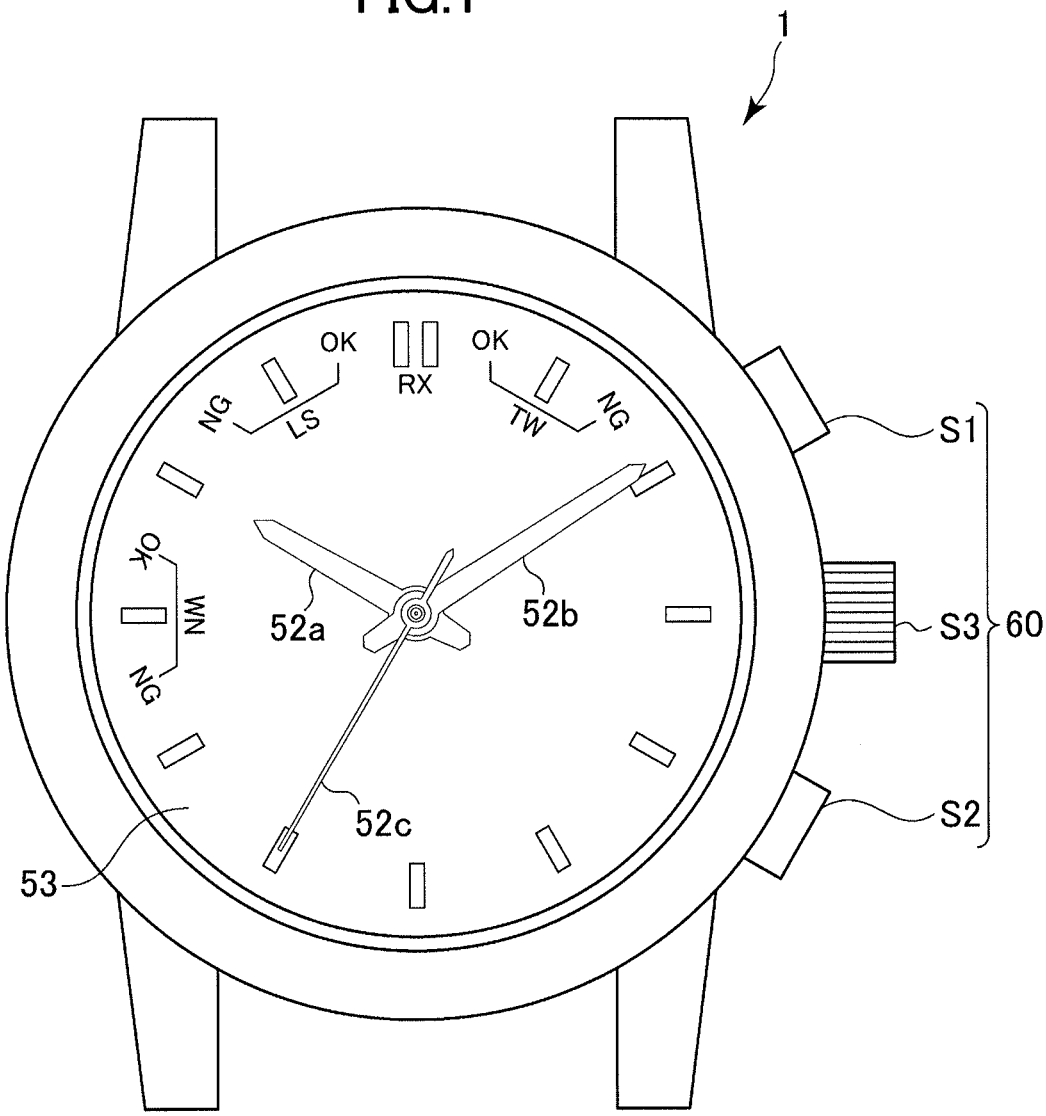
FIG. 1 A plan view illustrating an external appearance of a radio-controlled watch according to a first embodiment of the present invention.
Figure 2:
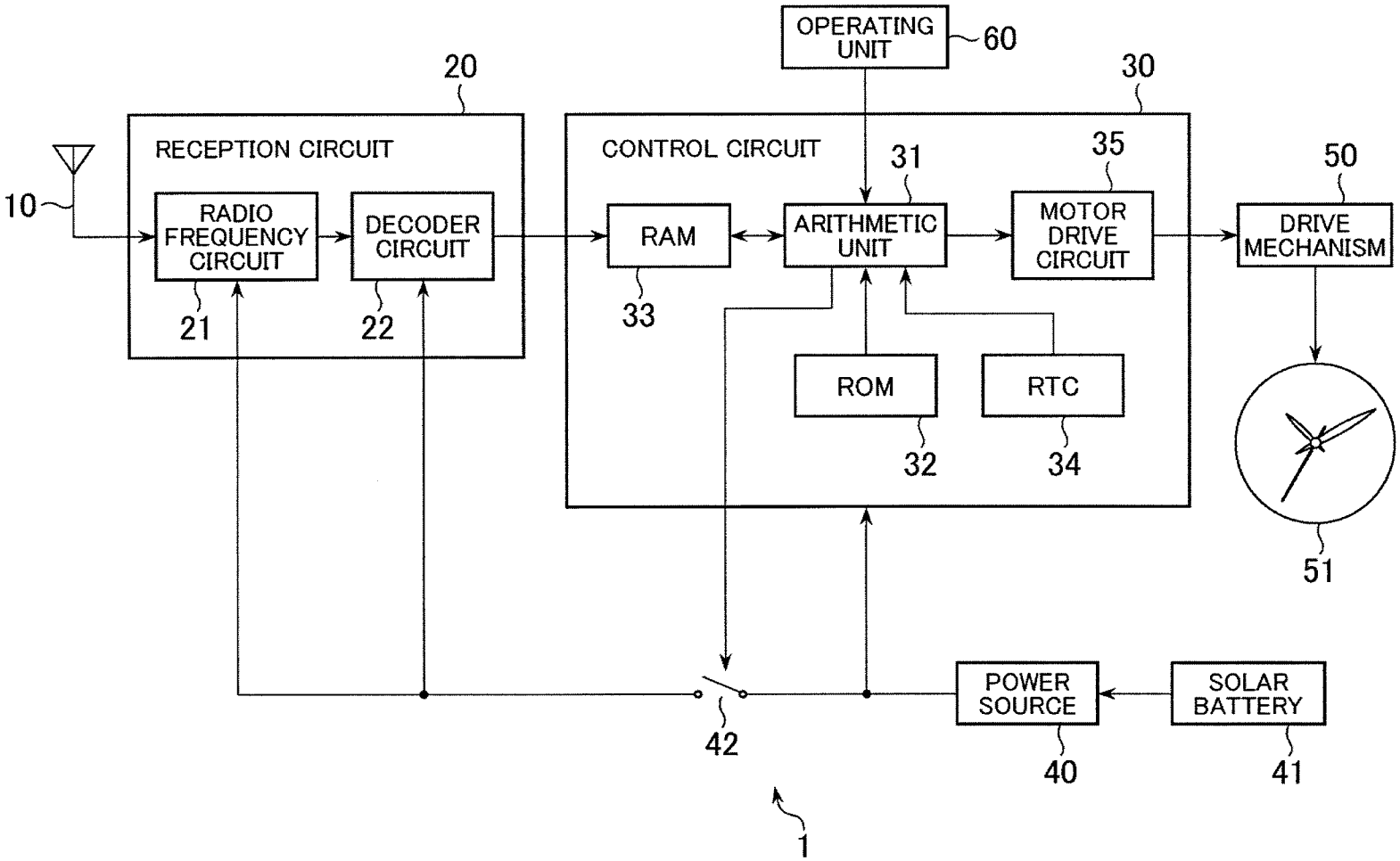
FIG. 2 A configuration block diagram illustrating an internal configuration of the radio-controlled watch according to the first embodiment of the present invention.

First, a radio-controlled watch according to a first embodiment of the present invention will be described. A radio-controlled watch 1 according to this embodiment receives a satellite signal containing time information transmitted from a satellite, and adjusts time information with the use of the received satellite signal. FIG. 1 is a plan view illustrating an external appearance of the radio-controlled watch 1 according to this embodiment. FIG. 2 is a configuration block diagram illustrating an internal configuration of the radio-controlled watch 1. As illustrated in FIG. 2, the radio-controlled watch 1 includes an antenna 10, a reception circuit 20, a control circuit 30, a power source 40, a solar battery 41, a drive mechanism 50, a time display unit 51, and an operating unit 60.

The antenna 10 receives a satellite signal transmitted from a satellite. In this embodiment, the antenna 10 receives a radio signal having a frequency of about 1.6 GHz transmitted from a Global Positioning System (GPS) satellite. GPS is one kind of satellite positioning system, which is realized by a plurality of GPS satellites orbiting around the earth. Those GPS satellites each carry a highly-accurate atomic clock and periodically transmit a satellite signal containing information on the time counted by the atomic clock. Note that in the following, the time indicated by the time information contained in the satellite signal is referred to as GPS time.

The reception circuit 20 decodes the satellite signal received by the antenna 10, and outputs a bit sequence (received data) indicating the contents of the satellite signal, which are obtained as a result of the decoding. Specifically, the reception circuit 20 includes a radio frequency circuit (RF circuit) 21 and a decoder circuit 22.

The radio frequency circuit 21 is an integrated circuit that operates at a high frequency. The radio frequency circuit 21 amplifies and detects an analog signal received by the antenna 10, and converts the analog signal into a baseband signal. The decoder circuit 22 is an integrated circuit that performs baseband processing. The decoder circuit 22 decodes the baseband signal output by the radio frequency circuit 21 to generate a bit sequence indicating the contents of data received from the GPS satellite, and outputs the bit sequence to the control circuit 30.

The control circuit 30 is a microcomputer or the like, and includes an arithmetic unit 31, a read only memory (ROM) 32, a random access memory (RAM) 33, a real time clock (RTC) 34, and a motor drive circuit 35.

The arithmetic unit 31 performs various kinds of information processing in accordance with a program stored in the ROM 32. The details of the processing executed by the arithmetic unit 31 in this embodiment will be described later. The RAM 33 functions as a working memory of the arithmetic unit 31, and data to be processed by the arithmetic unit 31 is written in the RAM 33. Particularly in this embodiment, the bit sequence (received data) indicating the contents of the satellite signal received by the reception circuit 20 is sequentially written into a buffer area of the RAM 33. Further, a leap second correction value LS to be used for adjusting the time information is stored in the RAM 33. The RTC 34 supplies a clock signal to be used for counting performed inside the radio-controlled watch 1. In the radio-controlled watch 1 according to this embodiment, the arithmetic unit 31 adjusts the internal time, which is counted by the signal supplied from the RTC 34, based on the satellite signal received by the reception circuit 20, and determines the time (display time) to be displayed on the time display unit 51. In addition, the motor drive circuit 35 outputs, in accordance with the determined display time, a drive signal for driving a motor included in the drive mechanism 50 to be described later. In this way, the display time generated by the control circuit 30 is displayed on the time display unit 51.

The power source 40 includes a power storage device such as a secondary battery, and stores electric power generated by the solar battery 41. The power source 40 then supplies the stored electric power to the reception circuit 20 and the control circuit 30. In particular, a switch 42 is provided in the course of a power supply path from the power source 40 to the reception circuit 20, and the switch 42 is switched between ON and OFF by a control signal output by the control circuit 30. In other words, the control circuit 30 can control an operation time of the reception circuit 20 by switching the ON/OFF state of the switch 42. The reception circuit 20 operates only in a period during which the electric power is supplied from the power source 40 via the switch 42, and decodes the satellite signal received by the antenna 10 during this period.

The solar battery 41 is disposed under a watch face 53, generates electric power using external light such as solar light radiated to the radio-controlled watch 1, and supplies the generated electric power to the power source 40.

The drive mechanism 50 includes a stepper motor that operates in accordance with the above-mentioned drive signal output from the motor drive circuit 35, and a gear train. The gear train transmits the rotation of the stepper motor, to thereby rotate indicator hands 52. The time display unit 51 includes the indicator hands 52 and the watch face 53. The indicator hands 52 include an hour hand 52*a*, a minute hand 52*b*, and a second hand 52*c*. Those indicator hands 52 rotate on the watch face 53, to thereby indicate the current time. Note that on the watch face 53, as illustrated in FIG. 1, there are displayed not only scales for time display but also markers to be described later for indicating the validity/invalidity of the leap second correction value LS and the success/failure of the reception of the time information to a user. Display examples of using those markers are described later.

The operating unit 60 receives an operation performed by the user of the radio-controlled watch 1, and outputs the contents of the operation to the control circuit 30. Specifically, the operating unit 60 in this embodiment includes, as illustrated in FIG. 1, two operation buttons of a first operation button S1 and a second operation button S2, and a crown S3. In accordance with the contents of the operation input received by the operating unit 60, the control circuit 30 executes processing to be described later, such as updating of the leap second correction value LS and reception of the satellite signal. In this way, the user can cause the radio-controlled watch 1 to execute the operation such as the leap second correction by operating the operating unit 60.

Figure 3:
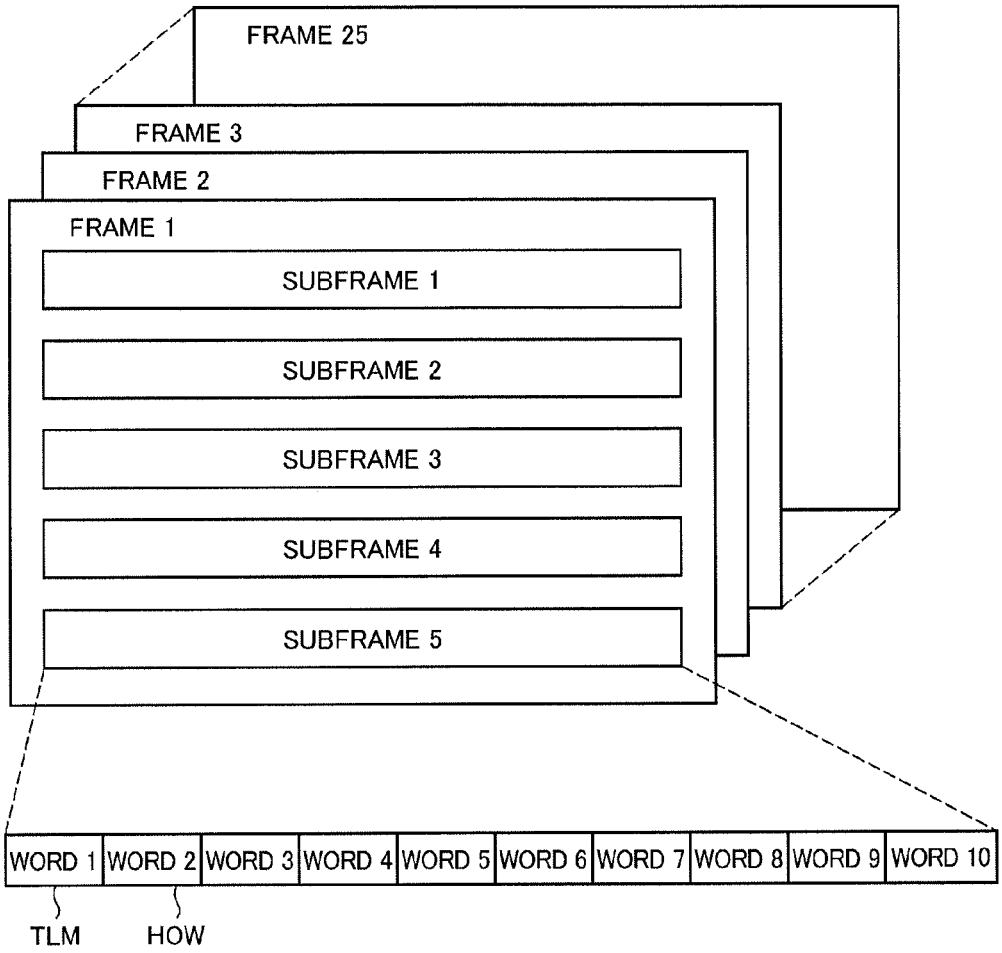
FIG. 3 An outline diagram illustrating the structure of a satellite signal transmitted from a GPS satellite.

Now, the structure of the satellite signal transmitted from the GPS satellite will be described. FIG. 3 is an outline diagram illustrating the structure of the satellite signal (navigation data) transmitted from the GPS satellite. As illustrated in FIG. 3, each GPS satellite repeatedly transmits navigation data with a set of 25 frames (pages) in total. Each frame contains a signal of 30 seconds, and the GPS satellite transmits a signal having 25 frames in total at a cycle of 12.5 minutes. Further, each frame consists of five subframes. One frame is 30 seconds, and hence one subframe corresponds to a signal of 6 seconds. In addition, one subframe consists of 10 words and one word has 30 bits, and hence one entire subframe contains information of 300 bits.

The head word (Word 1) in each subframe is called a Telemetry Word (TLM), containing a preamble indicating the start position of the subframe at its header (that is, at the header of the entire subframe). The second word (Word 2) in each subframe is called a Handover Word (HOW), containing time information called Time Of Week (TOW) at its header. The TOW is time information indicating GPS time starting from the beginning of a week (Sunday at 0:00 a.m.). The radio-controlled watch 1 receives the TOW data from one or a plurality of GPS satellites, and uses a combination of the TOW data and information on a week number WN so as to know the GPS time counted by the GPS satellite. The week number WN is information indicating the number of a week to which the time indicated by the TOW belongs, and is counted up once a week every Sunday at 0:00 a.m. The information on the week number WN is transmitted from the GPS satellite in the state of being stored in Subframe 1 of each frame.

The radio-controlled watch 1 receives the TOW contained in any one of the subframes, and can therefore acquire time information transmitted by the GPS satellite. However, the GPS time indicated by the time information is deviated from Coordinated Universal Time by several integer seconds caused by the leap second. Specifically, the GPS time is deviated from Coordinated Universal Time by a period of the leap seconds accumulated after the first launch of the GPS satellite (in 1980). Therefore, the radio-controlled watch 1 is required to adjust the GPS time obtained from the GPS satellite to the time under Coordinated Universal Time with the use of the leap second information.

The information relating to the leap second necessary for the adjustment is also transmitted regularly from the GPS satellite. Specifically, in the satellite signal having 25 frames in total transmitted by the GPS satellite, the leap second information is contained in Subframe 4 of the frame of Page 18. The latter five words of the subframe (that is, 151st and subsequent bits counted from the header) are information relating to Coordinated Universal Time, and the information relating to Coordinated Universal Time contains information on an integer value to be corrected with respect to the GPS time for the leap second adjustment (hereinafter, the integer value is referred to as leap second correction value LS). The leap second correction value LS is contained only in one subframe of all pieces of navigation data, and hence is transmitted from the GPS satellite once every 12.5-minute cycle. The radio-controlled watch 1 according to this embodiment performs the leap second correction by extracting the leap second correction value LS contained in the satellite signal received from the GPS satellite. As an alternative for the case where the information on the leap second correction value LS cannot be received from the GPS satellite, the radio-controlled watch 1 is provided with a function of enabling the user to change the leap second correction value LS manually.

Note that the subframe containing the leap second correction value LS contains, in addition to the leap second correction value LS, information on the scheduled date and time of the next leap second adjustment (leap second adjustment announcement information). This information is updated when the scheduled date of implementation of the next leap second adjustment is determined, and indicates the date and time of the previous leap second adjustment until the next leap second adjustment implementation time is determined. When the leap second adjustment announcement information indicates future date and time, it is understood that the leap second correction value LS will not be changed until the indicated date and time arrive.

Figure 4:
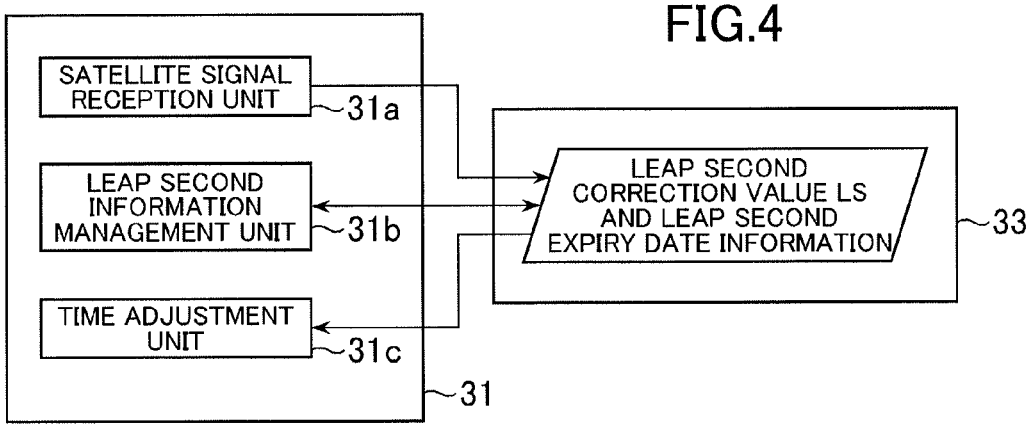
FIG. 4 A functional block diagram illustrating functions implemented by the radio-controlled watch according to the first embodiment of the present invention.

Hereinafter, a specific example of the processing executed by the arithmetic unit 31 of the control circuit 30 in this embodiment will be described. The arithmetic unit 31 executes the program stored in the ROM 32, to thereby functionally implement a satellite signal reception unit 31*a*, a leap second information management unit 31*b*, and a time adjustment unit 31*c* as illustrated in FIG. 4.

The satellite signal reception unit 31*a* receives the satellite signal transmitted from the GPS satellite, to thereby acquire data on the TOW and the week number WN contained in the satellite signal. Note that, the satellite signal reception unit 31*a* may execute the processing of acquiring such time information regularly, or may execute the processing in response to a user's instruction operation with respect to the operating unit 60. Further, in this embodiment, the satellite signal reception unit 31*a* tries to receive a subframe containing the leap second correction value LS at a predetermined time. When the reception has succeeded, the satellite signal reception unit 31*a* extracts the leap second correction value LS from the received data, and stores the leap second correction value LS in the RAM 33.

The leap second information management unit 31*b* manages the leap second correction value LS stored in the RAM 33. Specifically, the RAM 33 stores the information on the leap second correction value LS and also information relating to an expiry date of the leap second correction value LS (leap second expiry date information), and the leap second information management unit 31*b* uses the leap second expiry date information to determine whether the leap second correction value LS stored in the RAM 33 is valid or not (that is, whether the expiry date of the leap second correction value LS has expired or not). When it is determined that the expiry date of the leap second correction value LS has expired, the leap second information management unit 31*b* further executes processing of updating the leap second correction value LS manually in response to a user's instruction. That is, when the expiry date of the leap second correction value LS stored in the RAM 33 has expired, the leap second information management unit 31*b* displays and updates the leap second correction value LS stored in the RAM 33 in response to a user's instruction operation with respect to the operating unit 60. A specific example of the processing of updating the leap second correction value LS executed by the leap second information management unit 31*b* will be described later.

The time adjustment unit 31*c* adjusts the internal time counted inside the radio-controlled watch 1 with the use of the GPS time information received from the GPS satellite by the satellite signal reception unit 31*a* and the leap second correction value LS stored in the RAM 33. Specifically, the time adjustment unit 31*c* first adds the leap second correction value LS to the GPS time to calculate time information based on Coordinated Universal Time. Then, the time adjustment unit 31*c* adjusts the internal time counted inside the control circuit 30 so as to coincide with the time under Coordinated Universal Time. Note that the internal time information of the radio-controlled watch 1, which is to be adjusted by the time adjustment unit 31*c*, is stored in the RAM 33 and is updated in accordance with the clock signal supplied from the RTC 34. In this case, the time adjustment unit 31*c* may adjust the time with the use of the leap second correction value LS even when the expiry date of the leap second correction value LS has expired. This is because even when the expiry date set inside the radio-controlled watch 1 has expired, the time based on Coordinated Universal Time can be calculated with the use of the leap second correction value LS stored in the RAM 33 as long as new leap second adjustment is not actually performed.

Hereinafter, the expiry date of the leap second correction value LS, which is managed by the leap second information management unit 31*b*, will be described. The leap second adjustment with respect to Coordinated Universal Time is performed on the last day of each month, under Coordinated Universal Time. Accordingly, for example, when the leap second correction value LS has been manually updated, the leap second information management unit 31*b* determines that the currently-stored leap second correction value LS is valid until at least the last day of the month where the update has been performed. Further, the adjustment of the leap second is to be performed preferentially on the last day of June and the last day of December, and is not actually performed on other days. Therefore, the leap second information management unit 31*b* may determine that the leap second correction value LS is valid until the last day of the next June or the last day of the next December after the leap second correction value LS has been updated. Otherwise, the leap second information management unit 31*b* may determine that the leap second correction value LS is valid until a predetermined period has elapsed since the update of the leap second correction value LS or until the arrival of a predetermined date and time.

As a specific method of managing the expiry date of the leap second correction value LS, for example, when the leap second correction value LS has been manually updated, in response to the update, the leap second information management unit 31*b* updates a leap second validity flag to a value indicating "valid", and also updates information indicating until what month the updated leap second correction value LS is valid (information on expiry month). In this example, the leap second validity flag and the information on the expiry month are used as leap second expiry date information. As an example, in the case where the leap second correction value LS is updated on February, 2010, the leap second information management unit 31*b* sets June, 2010, which is the month, of June and December, whose last day comes earlier after the updated date, as an expiry month. After that, when the 1st of each month arrives, the leap second information management unit 31*b* compares the information on the expiry month to the information on the internal time based on Coordinated Universal Time, which is stored in the RAM 33, to thereby determine whether the expiry month has passed or not. In the above-mentioned example, when Jul. 1, 2010, under Coordinated Universal Time arrives, it is determined that the expiry date of the leap second correction value LS has expired. In this case, the leap second information management unit 31*b* switches the leap second validity flag from the value indicating "valid" to a value indicating "invalid". By referring to the value of the leap second validity flag, the leap second information management unit 31*b* determines whether the currently-stored leap second correction value LS is valid or not.

Note that in this example, when the leap second correction value LS can be received from the GPS satellite by the satellite signal reception unit 31*a*, the leap second information management unit 31*b* may update the information on the expiry month by referring to the leap second adjustment announcement information which is transmitted from the GPS satellite together with the leap second correction value LS. That is, when the leap second adjustment announcement information indicates future date and time, the month corresponding to the date is set as the expiry month. With this configuration, the leap second information management unit 31*b* can determine whether the currently-stored leap second correction value LS is valid or not by referring to the information on the expiry month, irrespective of whether the reception of the leap second correction value LS has succeeded or not in the past. In this case, when the leap second adjustment announcement information indicates past date and time (that is, the next leap second adjustment implementation time is still unknown), the leap second information management unit 31*b* may update the expiry date information by a rule similar to that in the case where the leap second correction value LS has been manually updated.

As another example of the method of managing the leap second expiry date, in the case where the leap second correction value LS is set so as to expire on the last day of the month where the leap second correction value LS has been manually updated, the leap second information management unit 31*b* does not need to keep information on the expiry month. In this case, the leap second information management unit 31*b* manages the expiry date with the use of only the leap second validity flag as leap second expiry date information. That is, when the leap second correction value LS has been manually updated, the leap second validity flag is set to "valid", and when the 1st day of each month arrives, the leap second validity flag is changed to "invalid". With this, the leap second correction value LS which had been updated the previous month can be made invalid at the beginning of each month.

Note that in this example, the leap second information management unit 31*b* may change the method of managing the expiry date in accordance with whether the previous leap second correction value LS has been updated manually or updated by the reception of the satellite signal. Specifically, the leap second information management unit 31*b* further keeps, in the RAM 33, flag information indicating whether the previous leap second correction value LS has been manually updated or not. When the 1st day of each month arrives, if it is determined from the flag information that the previous update was performed manually, the leap second validity flag is changed to "invalid". On the other hand, if it is determined that the previous update was not performed manually but by the reception of the satellite signal, for example, similarly to the above-mentioned example, the leap second validity flag is updated based on the leap second adjustment announcement information received together with the leap second correction value LS.

As still another example of the method of managing the leap second expiry date, the leap second information management unit 31*b* may manage the expiry date of the leap second correction value LS with the use of a counter value indicating how much longer the leap second correction value LS is valid as the expiry date information. This counter value is information indicating the remaining valid period of the leap second correction value LS in predetermined time units, such as by hours, by days, and by months. As an example, in the case where the expiry date of the leap second correction value LS is managed with the use of a counter value to be counted by hours, the leap second information management unit 31*b* initializes the counter value to a predetermined value when the leap second correction value LS is manually updated. For example, when the expiry date of the leap second correction value LS is 30 days, the counter value is set to 720 (=30×24). After that, every hour, the leap second information management unit 31*b* updates the counter value to a value decremented by 1. Accordingly, the counter value gradually decreases with time, finally reaching 0 after the lapse of 720 hours. After the counter value becomes 0, the leap second information management unit 31*b* does not perform processing of decrementing the counter value any more. Then, when the counter value is 0, it is determined that the leap second correction value LS is not valid. Note that in this example, the leap second information management unit 31*b* may change the leap second validity flag to "invalid" at the time when the counter value becomes 0, or may determine whether the leap second correction value LS is valid or not based on whether the counter value is 0 or not, instead of using the leap second validity flag. Note that in this case also, if the leap second correction value LS has been updated by the reception of the satellite signal, a time period until the next leap second adjustment implementation time may be calculated based on the leap second adjustment announcement information, which has been received together with the leap second correction value LS, so as to set the counter value in accordance with the calculated value.

Figure 5:
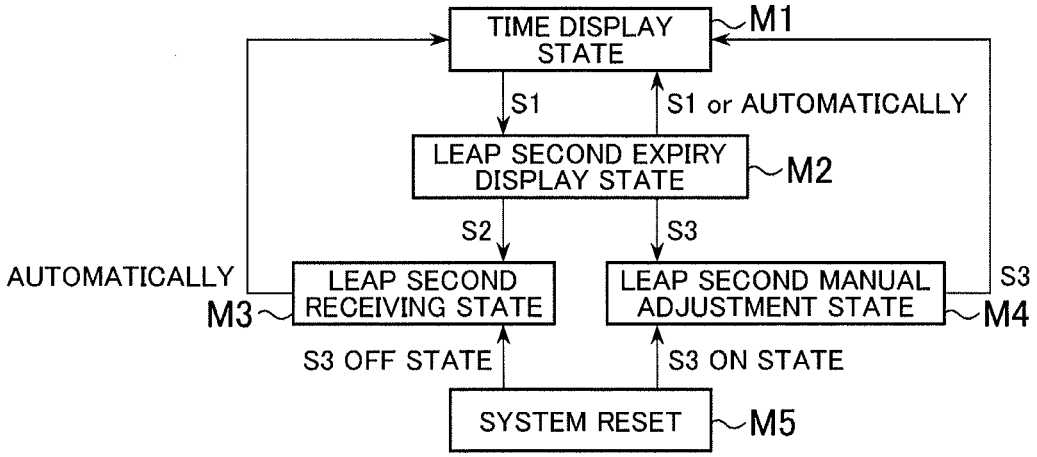
FIG. 5 A state transition diagram of the radio-controlled watch according to the first embodiment of the present invention.
Figure 6:
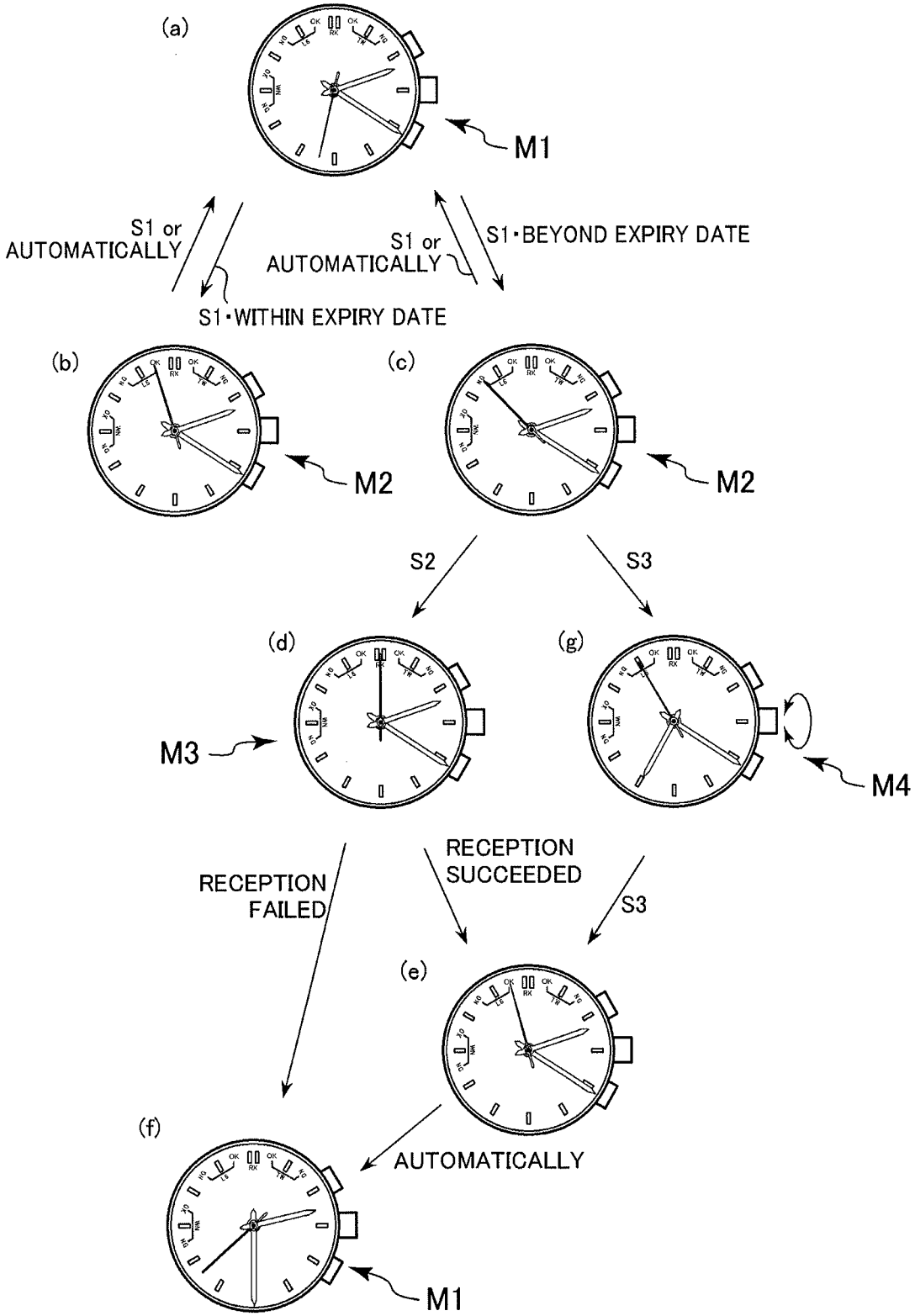
FIG. 6 An explanatory diagram illustrating a change in display state performed when the radio-controlled watch according to the first embodiment of the present invention executes processing of updating the leap second.

Next, an exemplary operation procedure of updating the leap second correction value LS by the radio-controlled watch 1 will be described with reference to FIGS. 5 and 6. FIG. 5 is a state transition diagram of the radio-controlled watch 1 when the processing of updating leap second information is performed. FIG. 6 is an explanatory diagram illustrating a change in display state on the watch face 53.

First, in a normal time display state M1 in which the current date and time are displayed by the indicator hands 52 as illustrated in part (a) of FIG. 6, the user performs an operation of pressing the first operation button S1. Then, the radio-controlled watch 1 makes a transition to a leap second expiry display state M2, and displays whether the currently-held leap second correction value LS is valid or not. Specifically, in the case where it is determined from the above-mentioned processing that the leap second correction value LS is valid, as illustrated in part (b) of FIG. 6, the second hand 52*c* moves to and stops at a position indicating "LS-OK" between the 11 o'clock position and the 12 o'clock position. On the other hand, in the case where it is determined by the leap second information management unit 31*b* that the leap second correction value LS is not valid, as illustrated in part (c) of FIG. 6, the second hand 52*c* moves to and stops at a position indicating "LS-NG" between the 10 o'clock position and the 11 o'clock position.

In the leap second expiry display state M2, when the user presses the first operation button S1 again, the radio-controlled watch 1 returns to the time display state M1, and brings the second hand 52*c* back to the position corresponding to the current time. In the case where the leap second correction value LS is valid, it is not necessary to update the leap second correction value LS, and hence the user only needs to press the first operation button S1 so that the radio-controlled watch 1 may return to the time display state M1. Note that also in the case where the user has performed no operation for a predetermined period since the transition to the leap second expiry display state M2, the radio-controlled watch 1 automatically returns to the time display state M1. On the other hand, in the case where the expiry date of the leap second correction value LS has expired, the user selects whether to press the second operation button S2 to cause the radio-controlled watch 1 to execute the reception of the leap second information or perform an operation of pulling out the crown S3 to manually update the leap second information.

In the leap second expiry display state M2, when the user presses the second operation button S2, the radio-controlled watch 1 makes a transition to a leap second receiving state M3. In this state, the satellite signal reception unit 31*a* tries to receive a satellite signal containing a leap second correction value LS transmitted from a GPS satellite. In this case, as illustrated in part (d) of FIG. 6, the radio-controlled watch 1 moves the second hand 52*c* to a position indicating an "RX" marker in the 12 o'clock position in order to notify the user that the reception is in progress.

After that, when the reception of the leap second correction value LS has succeeded, the leap second information management unit 31*b* stores the received leap second correction value LS in the RAM 33 and resets the expiry date of the leap second correction value LS, and the time adjustment unit 31*c* performs time correction processing with the use of the leap second correction value LS newly received. Then, in order to notify the user that the reception of the leap second correction value LS has succeeded, the radio-controlled watch 1 moves the second hand 52*c* to the position indicating "LS-OK" and temporarily stops the second hand 52*c* at this position as illustrated in part (e) of FIG. 6. After that, the radio-controlled watch 1 returns to the time display state M1 illustrated in part (f) of FIG. 6 automatically (irrespective of the user's operation).

On the other hand, when the reception of the leap second correction value LS has failed, the radio-controlled watch 1 returns to the time display state M1 without updating the leap second correction value LS. Note that in FIG. 6, the radio-controlled watch 1 immediately returns to the time display state M1 when the reception of the leap second correction value LS has failed, but similarly to the case where the reception of the leap second correction value LS has succeeded, the radio-controlled watch 1 may return to the time display state M1 after moving the second hand 52*c* temporarily to the position of "LS-NG" in order to indicate that the reception of the leap second correction value LS has failed. Alternatively, when the reception of the leap second correction value LS has failed, the radio-controlled watch 1 may return to the leap second expiry display state M2 as illustrated in part (c) of FIG. 6 in order to indicate that the expiry date of the leap second correction value LS has still expired, instead of returning to the time display state M1.

In the leap second expiry display state M2, when the user performs the operation of pulling out the crown S3, the radio-controlled watch 1 makes a transition to a leap second manual adjustment state M4. In this state, as illustrated in part (g) of FIG. 6, the leap second information management unit 31*b* displays a numerical value corresponding to the leap second correction value LS stored in the RAM 33 on the time display unit 51. In the example of part (g) of FIG. 6, the hour hand 52*a* is moved to the position corresponding to the leap second correction value LS, to thereby display the leap second correction value LS. Note that in this case, the second hand 52*c* indicates the 11 o'clock position in between "LS-OK" and "LS-NG" in order to indicate that the radio-controlled watch 1 is in the leap second manual adjustment state M4. When the user rotates the crown S3 in this state, the leap second information management unit 31*b* rotates the hour hand 52*a* in accordance with the rotation direction of the crown S3 and the rotation amount thereof. In this case, for example, the user refers to the current leap second information released on a website on the Internet or the like, and moves the hour hand 52*a* to the position corresponding to the obtained leap second. Then, when the user finally pushes the crown S3 to bring the crown S3 back to the normal position, the leap second information management unit 31*b* determines that the adjustment of the leap second correction value LS by the user has been finished, and updates the leap second correction value LS to a value corresponding to the position of the hour hand 52*a* at that time point. After that, similarly to the case where the reception of the leap second has succeeded in the leap second receiving state M3, the radio-controlled watch 1 automatically returns to the time display state M1 via the display illustrated in part (e) of FIG. 6.

The display method illustrated in part (g) of FIG. 6 is merely an example, and the leap second information management unit 31*b* may display a numerical value corresponding to the leap second correction value LS by another method. For example, in part (g) of FIG. 6, the numerical value is displayed by the position of the hour hand 52*a*, but the numerical value may be displayed by the position of the minute hand 52*b*. Further, in the above-mentioned example, the operating states of the radio-controlled watch 1 are indicated by the secondhand 52*c* indicating the markers such as "LS-OK", "LS-NG", and "RX", but, for example, in the case of displaying those states by a dedicated indicator hand, the numerical value corresponding to the leap second correction value LS may be displayed with the use of the second hand 52*c*. In addition, the leap second information management unit 31*b* may display the numerical value corresponding to the leap second correction value LS by a combination of at least two of the hour hand 52*a*, the minute hand 52*b*, and the second hand 52*c*. In this case, for example, the leap second information management unit 31*b* displays the numerical value by such control as overlaying a plurality of indicator hands 52 (such as the hour hand 52*a* and the minute hand 52*b*) so as to indicate the same position. With this configuration, it is possible to clearly notify the user that the normal time display is not performed but the display of the numerical value corresponding to the leap second correction value LS is performed.

Note that in the leap second manual adjustment state M4, the leap second information management unit 31*b* can display the numerical value of the leap second correction value LS as it is, but may display a numerical value corresponding to the leap second correction value LS by adding or subtracting a predetermined numerical value to or from the numerical value of the leap second correction value LS. As described above, GPS time information received by the radio-controlled watch 1 according to this embodiment is deviated from Coordinated Universal Time by a period corresponding to the leap seconds accumulated after Jan. 1, 1980. As of Jan. 1, 1980, a deviation of 19 seconds was present between International Atomic Time and Coordinated Universal Time. It follows that a difference of 19 seconds is always present between GPS time and International Atomic Time. Therefore, the leap second correction value LS for adjusting the GPS time to Coordinated Universal Time is smaller by 19 seconds than a correction amount for adjusting International Atomic Time to Coordinated Universal Time. In light of this, the leap second information management unit 31*b* may display a value obtained by adding 19 seconds to the leap second correction value LS on the time display unit 51. Specifically, in the example of part (g) of FIG. 6, the hour hand 52*a* indicates the position corresponding to a value of "34" obtained by adding 19 seconds to a leap second correction value LS of 15 seconds. In this state, when the user rotates the crown S3 to move the hour hand 52*a*, the leap second correction value LS is updated by a value obtained by subtracting 19 from the numerical value indicated by the hour hand 52*a*. With this configuration, the user does not need to be aware of the deviation of the GPS time from International Atomic Time, and can update the leap second correction value LS to such a value that may adjust the GPS time to Coordinated Universal Time accurately by changing the value displayed on the time display unit 51 to a numerical value publicly released as a deviation between International Atomic Time and Coordinated Universal Time (the accumulated value of the leap seconds).

Figure 7:
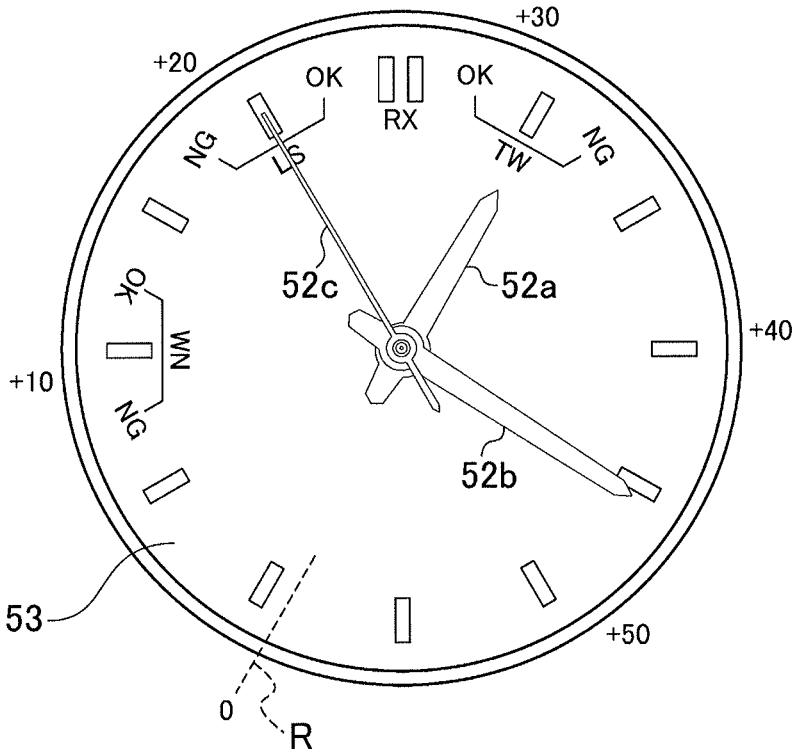
FIG. 7 A diagram illustrating a display example of a numerical value corresponding to a leap second correction value.

Alternatively, the leap second information management unit 31*b* may display the leap second correction value LS as a relative value with respect to the initial value thereof (for example, the leap second correction value LS stored in the ROM 32 at the time of shipment of the radio-controlled watch 1). FIG. 7 illustrates a display example of the numerical value corresponding to the leap second correction value LS in such an example. Note that FIG. 7 illustrates an example in which the initial value of the leap second correction value LS is 15 seconds and, similarly to the case of part (g) of FIG. 6, a value (34 seconds) obtained by adding 19 seconds to the initial value is set as a reference value of the leap second adjustment. The broken line in FIG. 7 represents an indicator position of the reference value (hereinafter, referred to as reference position R). Further, the numerical values around the watch face 53 represent indicator positions of numerical values obtained by adding 10 seconds, 20 seconds, . . . , and 50 seconds to the reference value, respectively. However, in this example, the reference position R and the relative values with respect to the reference value are not actually displayed on the watch face 53. In the example of FIG. 7, the hour hand 52*a* indicates the same position as that of part (g) of FIG. 6 in the case where the leap second correction value LS is between 15 seconds and 40 seconds (that is, the indicated value on the watch face 53 is 34 seconds to 59 seconds). In the case of part (g) of FIG. 6, the absolute value is displayed and hence a value of 60 seconds or more cannot be displayed. However, in FIG. 7, the numerical value is displayed by the relative position with the position of 34 seconds as the reference position R, and hence the user can set a numerical value up to 74 seconds (up to 93 seconds as an indicated value on the watch face 53) as the leap second correction value LS by operating the crown S3. Note that the value of 93 seconds is a value corresponding to +59 seconds as a relative value with respect to the reference value of 34 seconds. In the example of FIG. 7, the hour hand 52*a* indicates the 1 o'clock position, thus indicating an indicated value of 65 seconds (+31 seconds relative to the reference value of 34 seconds). In terms of specifications, the leap second adjustment includes both addition and deletion of the leap second, but in actual operation, the deletion of the leap second has not been implemented so far, and the accumulated value of the leap seconds has continued to increase. Therefore, there is no disadvantage even when, for example, a value corresponding to the accumulated value of the leap seconds at the time of shipment of the radio-controlled watch 1 is set as the initial value of the leap second correction value LS, and the leap second correction value LS is set based only on a positive relative value with respect to the initial value. Note that the reference position R of 34 seconds is merely an example. For example, in the case where the leap second correction value LS at the time of shipment is 26 seconds, and the position of 45 seconds obtained by adding an offset of 19 seconds to 26 seconds (the 9 o'clock position) is the reference position R, the numerical range which can be displayed is 45 seconds to 104 seconds, and accordingly the leap second correction value LS can be set within the range of 26 seconds to 85 seconds. In any case, the accumulated value of the leap seconds is displayed and set as the relative value with respect to the reference value, and hence the leap second correction value LS can be manually updated until the accumulated value of the leap seconds increases to be larger than the reference value by up to 59 seconds (that is, the seconds corresponding to one circuit on the watch face 53).

Further, in the state transition diagram of FIG. 5, when the second operation button S2 or the crown S3 is operated in the leap second expiry display state M2, the radio-controlled watch 1 makes a transition to the leap second receiving state M3 or the leap second manual adjustment state M4, respectively. However, the leap second information management unit 31*b* may restrict such a state transition in accordance with the result of determination as to whether the leap second correction value LS is valid or not. That is, the leap second information management unit 31*b* causes the radio-controlled watch 1 to make a transition to the leap second receiving state M3 or the leap second manual adjustment state M4 only in the case where it is determined that the expiry date of the leap second correction value LS has expired and this determination result is displayed in the leap second expiry display state M2, and the leap second information management unit 31*b* restricts such a transition in the case where it is determined that the expiry date of the leap second correction value LS has not expired. This configuration can prevent the user from unnecessarily updating the leap second correction value LS when the leap second correction value LS is valid.

Further, although not illustrated in FIGS. 5 and 6, the radio-controlled watch 1 may display, in response to a user's instruction operation, whether the reception of the TOW data has succeeded or not, or whether the reception of the week number WN data has succeeded or not. In addition, when the reception of the TOW data or the week number WN data has failed, the radio-controlled watch 1 may try to receive those pieces of data in response to the user's instruction operation, or may execute manual adjustment of the time or the calendar.

Now, control to be performed when the system of the radio-controlled watch 1 is restarted will be described. For example, in the case where the power supply voltage of the power source 40 has reduced and it becomes difficult to continue the operation, the radio-controlled watch 1 may execute processing of saving information in the RAM 33 into a non-volatile memory before system-down occurs, and normally terminating the control circuit 30. Alternatively, system reset of the control circuit 30 may be executed. In the case where such processing is executed and the control circuit 30 is thereafter restarted, the arithmetic unit 31 reacquires the leap second information as a part of start processing. Specifically, as illustrated in the state transition diagram of FIG. 5, at the time of recovery from the system reset state M5, the radio-controlled watch 1 makes a transition to any one of the leap second receiving state M3 and the leap second manual adjustment state M4 depending on the state of the crown S3 at that time. In other words, in the case where the crown S3 is not pulled out but is located at the normal position (in the case of S3 OFF state), the radio-controlled watch 1 makes a transition to the leap second receiving state M3 to try to receive the leap second information. On the other hand, in the case where the crown S3 is pulled out (in the case of S3 ON state), the radio-controlled watch 1 makes a transition to the leap second manual adjustment state M4 to update the leap second correction value LS in accordance with the user's operation to the crown S3. When the radio-controlled watch 1 is restarted, if the radio-controlled watch 1 has stopped for a long time before the restart, there is a high possibility that the expiry date of the leap second correction value LS has expired. Accordingly, by performing such update processing at the time of restart, the radio-controlled watch 1 can acquire the latest information of the leap second correction value LS. Note that when such restart processing is executed, it is also necessary to reacquire the data on the TOW and the week number WN. Reception processing of receiving such pieces of information from the GPS satellite may be executed either before or after the reception processing or manual update of the leap second correction value LS is performed.

Further, instead of making a transition to the leap second receiving state M3 or the leap second manual adjustment state M4 immediately after the restart, the radio-controlled watch 1 may refer to the leap second expiry date information at the previous time when the operation of the system stopped to determine whether the expiry date of the leap second correction value LS has expired or not, and may make a transition to the leap second receiving state M3 or the leap second manual adjustment state M4 as described above only when it is determined that the expiry date of the leap second correction value LS has expired. In this case, after the restart, the radio-controlled watch 1 first receives the data on the TOW and the week number WN to acquire information on the current date and time. Then, the radio-controlled watch 1 refers to the information on the current date and time and the leap second expiry date information to determine whether the expiry date of the leap second correction value LS has expired or not. When the expiry date of the leap second correction value LS has not expired, the radio-controlled watch 1 makes a transition to the time display state M1 to start normal time display.

According to the radio-controlled watch 1 of this embodiment described above, the leap second can be manually set, and hence, even when the reception of the leap second has not succeeded, the leap second information can be acquired and used for adjusting the time information received from the satellite signal. As described above, the transmission frequency of the leap second information from the GPS satellite is lower than that of the TOW and the like, and hence the chance of receiving the leap second information is restricted. Particularly in a portable watch such as a wristwatch, in some cases, a good reception condition cannot be ensured stably, and the leap second information cannot be received for a long time. According to the radio-controlled watch 1 of this embodiment, in such a case, the user can set the leap second manually as an alternative. In addition, when the setting of the leap second by the user is received, the expiry date is set with respect to the leap second information, and when the expiry date has expired, the user is notified of the expiation. Therefore, the user can easily know whether the leap second information needs to be reset or not.

Second Embodiment

Next, a radio-controlled watch according to a second embodiment of the present invention will be described. Note that the radio-controlled watch according to this embodiment is different from the radio-controlled watch according to the first embodiment in internal processing, but the hardware configuration and functional configuration may be the same as those in the first embodiment. Therefore, in the following, the same components as those in the first embodiment are denoted by the same reference symbols, and the detailed descriptions thereof are omitted.

In this embodiment, the satellite signal reception unit 31*a* acquires information on the TOW and the week number WN contained in a satellite signal, but does not receive information on the leap second correction value LS. In the ROM 32, an initial value of the leap second correction value LS is stored at the time of shipment, and the leap second information management unit 31*b* first reads the initial value and stores the initial value in the RAM 33. The leap second correction value LS stored in the RAM 33 is changed by manual updating by the user similarly to the first embodiment. The time adjustment unit 31*c* corrects the GPS time obtained from the TOW to the time based on Coordinated Universal Time with the use of the leap second correction value LS stored in the RAM 33.

Figure 8:
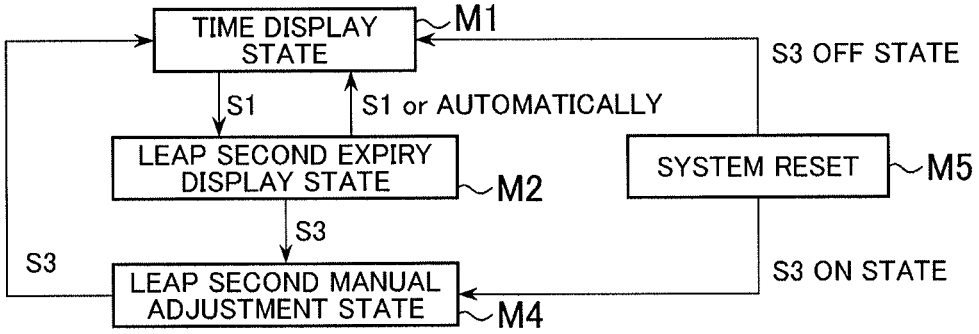
FIG. 8 A state transition diagram of a radio-controlled watch according to a second embodiment of the present invention.
Figure 9:
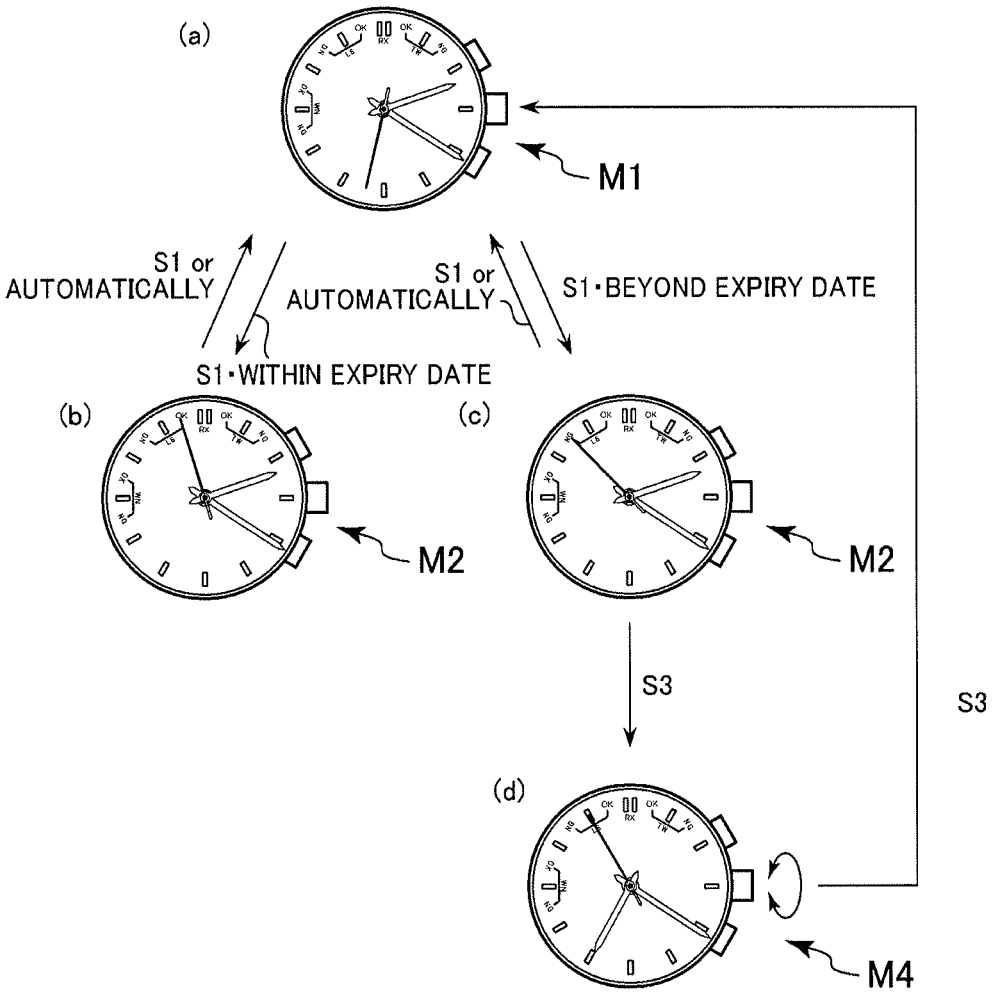
FIG. 9 An explanatory diagram illustrating the contents displayed when the radio-controlled watch according to the second embodiment of the present invention executes processing of updating the leap second.

Now, an exemplary operation procedure of updating the leap second correction value LS by the radio-controlled watch 1 in this embodiment will be described with reference to FIGS. 8 and 9. FIG. 8 is, similarly to FIG. 5, a state transition diagram of the radio-controlled watch 1 when the processing of updating leap second information is performed. FIG. 9 is, similarly to FIG. 6, an explanatory diagram illustrating a change in display state on the watch face 53.

First, in the normal time display state M1 in which the current date and time are displayed by the indicator hands 52 as illustrated in part (a) of FIG. 9, the user performs an operation of pressing the first operation button S1. Then, the radio-controlled watch 1 makes a transition to the second expiry display state M2, and displays whether the currently-held leap second correction value LS is valid or not. Specifically, in the case where the leap second correction value LS is valid, as illustrated in part (b) of FIG. 9, the second hand 52*c* moves to the position indicating "LS-OK", and in the case where the expiry date thereof has expired, as illustrated in part (c) of FIG. 9, the second hand 52*c* moves to the position indicating "LS-NG".

In the leap second expiry display state M2, when the user presses the first operation button S1, or when the predetermined period has elapsed while the user performs no operation, similarly to the first embodiment, the radio-controlled watch 1 returns to the time display state M1. On the other hand, when the expiry date of the leap second correction value LS has expired, the user performs an operation of pulling out the crown S3 to update the leap second information manually. The radio-controlled watch 1 according to this embodiment does not support the reception of the leap second information, and hence, unlike the first embodiment, the radio-controlled watch 1 cannot make a transition to the leap second receiving state M3 through the operation of the second operation button S2.

In the leap second expiry display state M2, when the user performs the operation of pulling out the crown S3, the radio-controlled watch 1 makes a transition to the leap second manual adjustment state M4. In this state, as illustrated in part (d) of FIG. 9, the leap second information management unit 31*b* moves the hour hand 52*a* to the position corresponding to the leap second correction value LS, to thereby display a numerical value corresponding to the leap second correction value LS stored in the RAM 33. In addition, the second hand 52*c* moves to the position of indicating the intermediate position of "LS-OK" and "LS-NG" (the 11 o'clock position). In this state, when the user rotates the crown S3, the leap second information management unit 31*b* rotates the hour hand 52*a* in accordance with the rotation direction and the rotation amount of the crown S3. Then, when the user finally pushes the crown S3 to bring the crown S3 back to the normal position, the leap second information management unit 31*b* determines that the correction of the leap second correction value LS by the user has been finished, and updates the leap second correction value LS to a value corresponding to the position of the hour hand 52*a* at that time point. In FIG. 9, unlike the first embodiment, when the manual update of the leap second correction value LS is finished, the second hand 52*c* does not indicate the position "LS-OK", but the radio-controlled watch 1 automatically returns to the time display state M1 as illustrated in part (a) of FIG. 9. However, similarly to the first embodiment, the radio-controlled watch 1 may return to the time display state M1 via the display as illustrated in part (e) of FIG. 6.

Note that similarly to the first embodiment, when returning from the system reset state M5, the radio-controlled watch 1 according to this embodiment may also make a transition to the leap second manual adjustment state M4 in accordance with the state of the crown S3 at the time of the return. In this case, as illustrated in the state transition diagram of FIG. 8, when the crown S3 is pulled out, the radio-controlled watch 1 makes a transition to the leap second manual adjustment state M4 at the time of the return from the system reset state M5. On the other hand, when the crown S3 is in the normal position, the radio-controlled watch 1 makes a transition to the time display state M1 because the processing of receiving the leap second information is not executed in this embodiment, unlike the first embodiment. In any case, similarly to the first embodiment, the radio-controlled watch 1 needs to receive the data on the TOW and the week number WN from the GPS satellite at the time of restart. Particularly in the case where the crown S3 is pulled out and the radio-controlled watch 1 makes a transition to the leap second manual adjustment state M4, the radio-controlled watch 1 preferably receives the data on the TOW and the week number WN after the leap second is manually adjusted and the user brings the crown S3 back to the normal position, instead of receiving those pieces of data before making a transition to the leap second manual adjustment state M4. This is because if the reception processing is performed before the radio-controlled watch 1 makes a transition to the leap second manual adjustment state M4, the manual adjustment of the leap second cannot be performed during the reception processing, which keeps the user waiting.

According to the radio-controlled watch 1 of this embodiment described above, the processing of receiving the leap second is not performed in the first place, and hence it is unnecessary to notify the user of an event such as a failure of reception of the leap second, thus making the operation easily understandable by the user. Further, power consumption due to the processing of receiving the leap second can be avoided. On the other hand, although the function of receiving the leap second is not provided, the manual setting of the leap second is received, and hence, when the leap second adjustment is performed, it is possible to display the time based on Coordinated Universal Time reflecting the contents of the leap second adjustment. Note that at present, the implementation frequency of the leap second adjustment is not so high, and hence, even if the user needs to set the leap second manually, not so much time and effort is required for the user.

Modified Example

The embodiments of the present invention are not limited to the ones described above. For example, the radio-controlled watch 1 in the above description is a wristwatch, but instead, may be various kinds of clock that adjust time by receiving a signal containing time information from a satellite. Besides, at least part of the processing to be executed by the arithmetic unit 31 of the control circuit 30 in the above description may be implemented by an independent arithmetic circuit, such as a logic circuit.

Further, the form of displaying whether the expiry date of the leap second correction value LS has expired or not and the form of displaying the numerical value corresponding to the leap second correction value LS, which are performed by the radio-controlled watch 1 according to the above-mentioned embodiments, are each an example. The radio-controlled watch according to the embodiments of the present invention may display those pieces of information in various different kinds of display form. For example, when the expiry date of the leap second correction value LS has expired, the radio-controlled watch 1 may display the expiration of the expiry date to a user by a method such as two-second interval movement. Further, the procedure of the instruction operation performed by the user when the processing of updating the leap second is performed may be various kinds of procedure other than the one described above.

Hereinafter, another display example of displaying, by the radio-controlled watch 1 according to the embodiments of the present invention, a numerical value corresponding to the leap second correction value LS in the above-mentioned leap second manual adjustment state M4 will be described. Note that in the following, a numerical value to be displayed and to be adjusted by a user in the leap second manual adjustment state M4 is referred to as an adjustment target value. As described above, the adjustment target value may be the leap second correction value LS itself, or may be a value obtained by adding a predetermined value (such as a value indicating a deviation between GPS time and International Atomic Time) to the leap second correction value LS.

Figure 10:
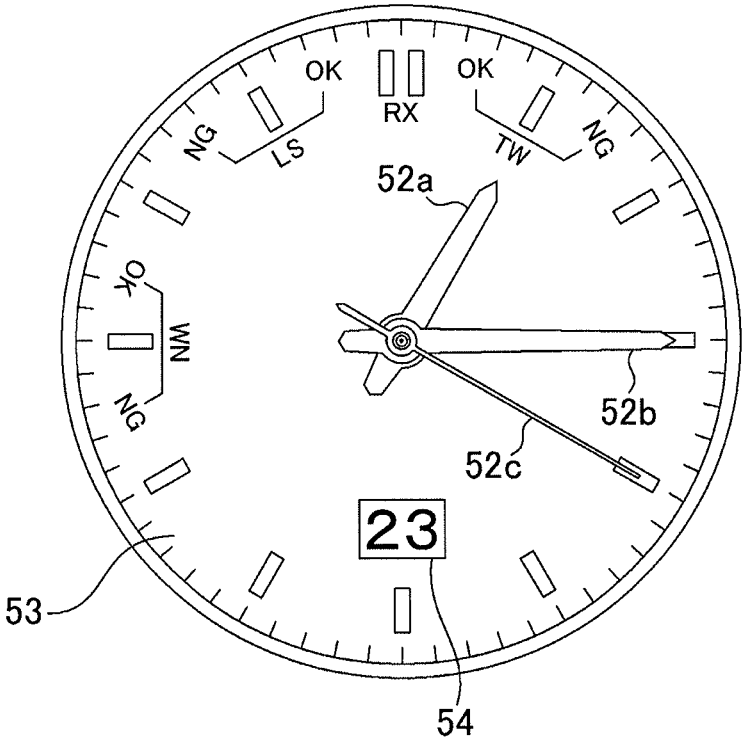
FIG. 10 A diagram illustrating another display example of the numerical value corresponding to the leap second correction value.

For example, the radio-controlled watch 1 may display the leap second correction value LS by a combination of the minute hand 52*b* and the second hand 52*c*. A first specific example in this case is that the radio-controlled watch 1 indicates the ones place value and the tens place value of the adjustment target value by the position of the second hand 52*c* and the position of the minute hand 52*b*, respectively. FIG. 10 illustrates a display example in this case. In the example of FIG. 10, the minute hand 52*b* indicates the 3 o'clock position and the second hand 52*c* indicates the 4 o'clock position, thus displaying 34 seconds as the adjustment target value. When the user performs the operation of rotating the crown S3 in such a display state, the user can adjust the leap second correction value LS.

In this case, the radio-controlled watch 1 may also display a rollover counter value using the position of the hour hand 52*a*. Here, the rollover counter value indicates the number of overflows of the above-mentioned week number WN since a predetermined start time. The week number WN contained in information transmitted by the GPS satellite is 10-bit information, whose maximum value is 1,023. Therefore, the week number WN overflows to be reset to 0 every 1,024 weeks (about 20 years). As a countermeasure, the radio-controlled watch 1 is sometimes provided with a rollover counter function of counting the number of overflows. In this case, the radio-controlled watch 1 adds 1 to the rollover counter value when the week number WN overflows. With this, even when the radio-controlled watch 1 is used for a long time of 20 years or more, it is possible to know which week, counted from the predetermined start time, the current time falls on, by a combination of the rollover counter value and the week number WN. Then, the calendar date can be displayed based on this information. In the display example of FIG. 10, day indication through a day indicator 54 is performed based on the thus obtained calendar date. Note that instead of using the day indicator 54, the radio-controlled watch 1 may switch from a time display mode to a calendar display mode in response to a user's instruction, and display the calendar date with the use of the indicator hands 52 in the calendar display mode.

However, in the case where the radio-controlled watch 1 provided with the rollover counter function has stopped for a long time including an overflow time of the week number WN, the rollover counter value cannot be counted up when the week number WN overflows, and it becomes impossible to know which week the current time falls on. As a countermeasure against such a case, as illustrated in FIG. 10, the rollover counter value stored in the RAM 33 of the radio-controlled watch 1 is displayed so as to be adjustable by a user's operation input. In the example of FIG. 10, the hour hand 52*a* indicates the 1 o'clock position, thus indicating a rollover counter value of 1. In this state, the user can adjust the rollover counter value by operating the first operation button S1, for example.

Figure 11:
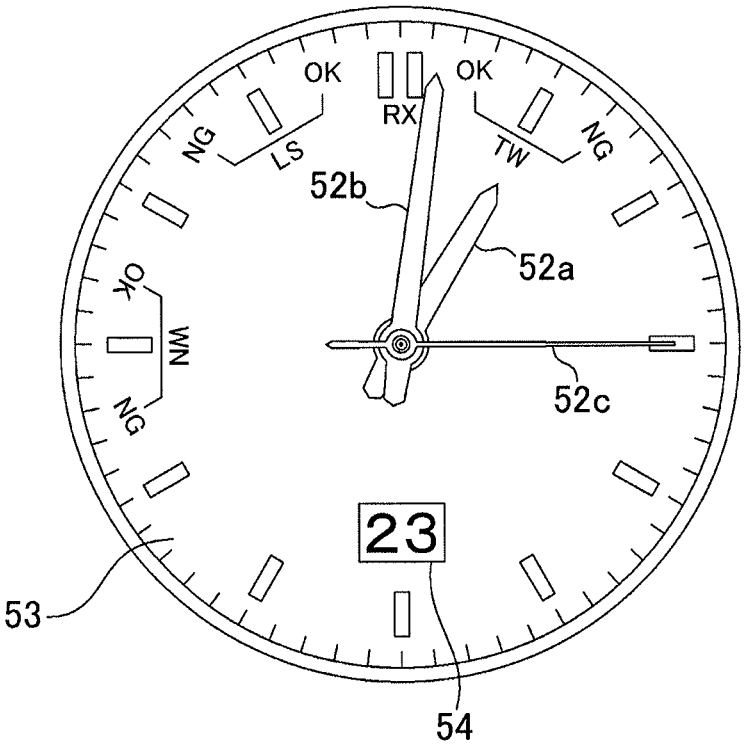
FIG. 11 A diagram illustrating still another display example of the numerical value corresponding to the leap second correction value.

FIG. 11 illustrates a second specific example of the method of displaying the adjustment target value by a combination of the minute hand 52*b* and the second hand 52*c*. In the second specific example, the radio-controlled watch 1 rotates the minute hand 52*b* and the second hand 52*c* to the same position as that when time is gained from 0 minutes 0 seconds, on the hour, by the same seconds as the adjustment target value. In other words, when the adjustment target value is less than 60 seconds, the radio-controlled watch 1 indicates the corresponding numerical value by the position of the second hand 52*c*. In this case, the minute hand 52*b* indicates the position of 0 minutes (in the 12 o'clock position, or the position having a rotation angle of less than 6 degrees from the 12 o'clock position). Further, when the adjustment target value is 60 seconds or more and less than 120 seconds, the minute hand 52*b* indicates the position of 1 minute (the position having a rotation angle of 6 degrees or more and less than 12 degrees from the 12 o'clock position), and the secondhand 52*c* indicates the position of a numerical value obtained by subtracting 60 from the adjustment target value. In the example of FIG. 11, the minute hand 52*b* and the second hand 52*c* are moved to the positions indicating 1 minute and 15 seconds, thus indicating that the adjustment target value is 75 seconds. Note that in this example, the rollover counter value is not displayed simultaneously with the adjustment target value but is displayed in another adjustment state, such as which second position the second hand 52*c* indicates. Further, also in this example, similarly to FIG. 10, day indication is performed by the day indicator 54 based on the calendar date obtained by a combination of the rollover counter value and the information on the week number WN.

Figure 12:
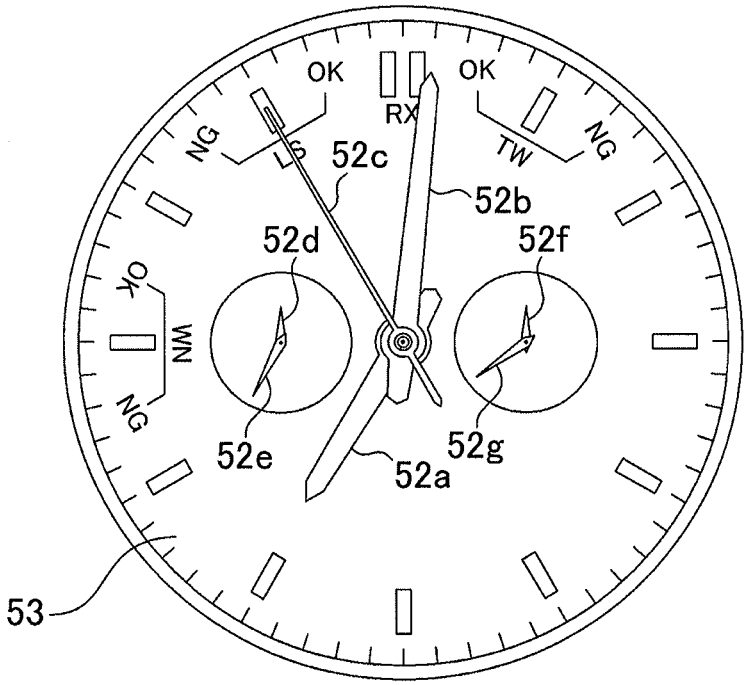
FIG. 12 A diagram illustrating a further display example of the numerical value corresponding to the leap second correction value.

Further, the radio-controlled watch 1 may display the adjustment target value with the use of other indicator hands than the hour hand 52*a*, the minute hand 52*b*, and the second hand 52*c* for time display. FIG. 12 illustrates a display example in this case. In this example, a first small hand 52*d*, a second small hand 52*e*, a third small hand 52*f*, and a fourth small hand 52*g* are disposed on the watch face 53, in addition to the hour hand 52*a*, the minute hand 52*b*, and the second hand 52*c*. Note that the first small hand 52*d* and the second small hand 52*e* are disposed on the watch face 53 on the 9 o'clock side so as to be rotatable around a common center shaft, and the third small hand 52*f* and the fourth small hand 52*g* are disposed on the watch face 53 on the 3 o'clock side so as to be rotatable around a common center shaft. The radio-controlled watch 1 displays the adjustment target value in the leap second manual adjustment state M4 with the use of those small hands. Specifically, the radio-controlled watch 1 uses the first small hand 52*d* and the second small hand 52*e* to display an adjustment target value corresponding to a leap second correction value LS before updating, and uses the third small hand 52*f* and the fourth small hand 52*g* to display an adjustment target value after the user operates the crown S3 to perform adjustment. Note that the method of displaying the adjustment target value with the use of two small hands may be the same as the above-mentioned method of displaying the adjustment target value by a combination of the minute hand 52*b* and the second hand 52*c*. When the user performs an operation of rotating the crown S3 in the leap second manual adjustment state M4, the first small hand 52*d* and the second small hand 52*e* keep their positions, but only the third small hand 52*f* and the fourth small hand 52*g* are rotated in response to the user's operation. With this, the user can adjust the leap second correction value LS in the state in which the user can check the adjustment target value that is before the user instructs the change.

Further, in the example of FIG. 12, the user can input the changed adjustment target value by operating the operating unit 60, and can also input the time of applying the leap second correction value LS corresponding to the input adjustment target value (application time). The radio-controlled watch 1 changes to a leap second correction value LS corresponding to an input adjustment target value at the time corresponding to the application time. Specifically, when the radio-controlled watch 1 receives inputs of the adjustment target value and the application time from the user, the radio-controlled watch 1 continues to directly use the leap second correction value LS before receiving the inputs until the arrival of the input application time. Then, when the input application time arrives, after that, the old leap second correction value LS is overwritten by a leap second correction value LS corresponding to the adjustment target value which has been received together with the application time. With this, at the time when the future change of the leap second correction value LS is announced, the user can immediately specify a leap second correction value LS to be changed in the future to the radio-controlled watch 1, and specify the future time at which the leap second correction value LS becomes valid. For example, the radio-controlled watch 1 displays an update time with the use of the hour hand 52*a* and the minute hand 52*b*. Specifically, in the example of FIG. 12, the hour hand 52*a* indicates the month of the update time and the minute hand 52*b* indicates the day of the update time. In FIG. 12, the hour hand 52*a* and the minute hand 52*b* indicate Time 7:01, thus indicating that July 1st is set as the update time. In the leap second manual adjustment state M4, the user switches the operation target from among the adjustment target value, the month of the update time, and the day of the update time by a method such as operating the first operation button 51 or the second operation button S2, and changes the value of each operation target by operating the crown S3. Note that in FIG. 12, in order to indicate the leap second manual adjustment state M4, the second hand 52*c* indicates the 11 o'clock position in between "LS-OK" and "LS-NG".

Figure 13:
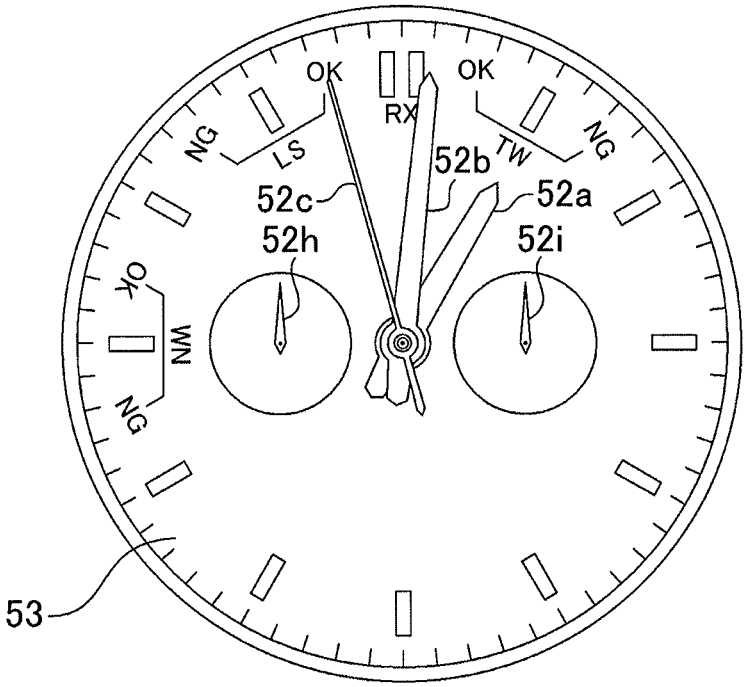
FIG. 13 A diagram illustrating a display example of an expiry date of the leap second correction value.

Further, in the case of displaying that the leap second correction value LS is valid in the leap second expiry display state M2, the radio-controlled watch 1 may also display how long the leap second correction value LS is valid for (that is, when the expiry date of the leap second correction value LS expires). In this case, the radio-controlled watch 1 performs display as exemplified in FIG. 13 instead of performing the above-mentioned display of part (b) of FIG. 6 or part (b) of FIG. 9. In FIG. 13, the hour hand 52*a* and the minute hand 52*b* are used to indicate what month and day the expiry date is. In this case, similarly to the display of the update time in FIG. 12, the hour hand 52*a* indicates the month of the expiry date and the minute hand 52*b* indicates the day of the expiry date. In FIG. 13, the hour hand 52*a* and the minute hand 52*b* indicate Time 1:01, thus indicating that the currently-stored leap second correction value LS is valid until the last day of December and that the expiry date will expire on January 1st. Note that, in FIG. 13, similarly to part (b) of FIG. 6 and part (b) of FIG. 9, the second hand 52*c* indicates "LS-OK".

Figure 14:
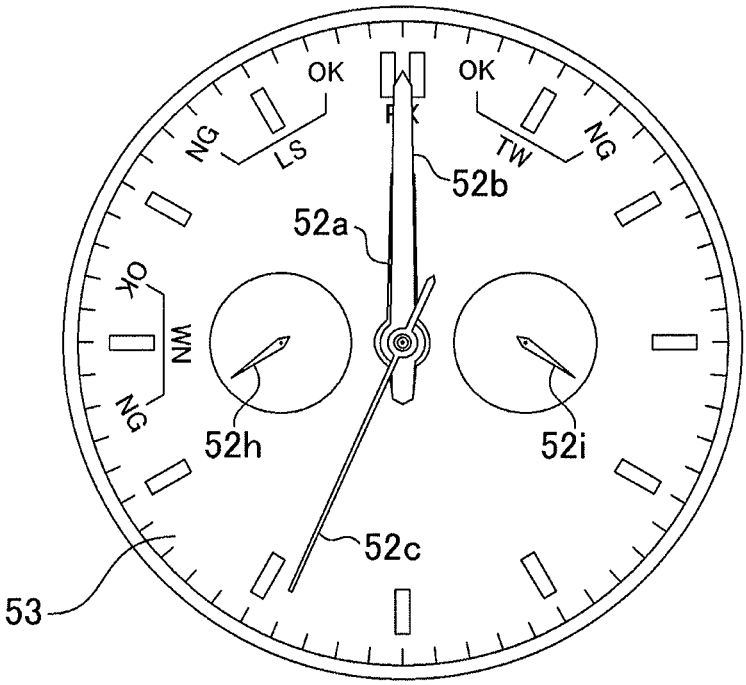
FIG. 14 A diagram illustrating a display example of information relating to the leap second correction value.

In addition, in the above description, in the states of part (b) of FIG. 6 and part (b) of FIG. 9 (the states indicating that the leap second correction value LS is valid), unlike the states of part (c) of FIG. 6 and part (c) of FIG. 9 (the states indicating that the leap second correction value LS is invalid), the radio-controlled watch 1 does not make a transition to the leap second manual adjustment state M4 even when the user operates the crown S3. In this case, when the user performs an operation of pulling out the crown S3 in the state indicating that the leap second correction value LS is valid, the radio-controlled watch 1 may display information relating to the currently-set leap second correction value LS instead of making a transition to the leap second manual adjustment state M4. FIG. 14 is a display example in this case, and illustrates a display example when the crown S3 is operated in the state in which the display of FIG. 13 is performed. In FIG. 14, as described above with reference to FIGS. 10 and 11, the minute hand 52*b* and the second hand 52*c* are used to display an adjustment target value corresponding to the leap second correction value LS, and a fifth small hand 52*h* and a sixth small hand 52*i* are used to display information relating to receiving environments under which the leap second correction value LS was received from the GPS satellite last time. Specifically, the fifth small hand 52*h* displays information on the satellite number indicating which of the plurality of GPS satellites the information on the leap second correction value LS was received from. The sixth small hand 52*i* displays information indicating what area (city) the leap second correction value LS was received in. Note that when the operation of pushing the crown S3 is performed in this state, the radio-controlled watch 1 returns to the time display state M1. Here, the information relating to the leap second correction value LS is displayed when a predetermined operation is further performed in the state in which the display of FIG. 13 is performed, but the present invention is not limited thereto. At the time of displaying the expiry date as illustrated in FIG. 13, the radio-controlled watch 1 may also display the information on the number of the satellite from which the information on the leap second correction value LS was received, the information on the city in which the information on the leap second correction value LS was received, and other such information.

The invention claimed is:

1. A radio-controlled watch that adjusts time by receiving a signal containing time information from a satellite, the radio-controlled watch comprising:

storage means for storing a leap second correction value to be used for leap second correction with respect to the time information;

leap second display means for displaying a numerical value corresponding to the leap second correction value stored in the storage means;

instruction receiving means for receiving an instruction operation of changing the leap second correction value from a user in a state in which the leap second display means displays the numerical value; and leap second correction value changing means for changing the leap second correction value stored in the storage means in response to the received instruction operation, wherein:

the storage means further stores information relating to an expiry date of the leap second correction value;

the leap second correction value changing means updates the information relating to the expiry date when changing the leap second correction value; and the radio-controlled watch further comprises determination result display means for determining, with use of the information relating to the expiry date, whether the leap second correction value stored in the storage means is valid or not, and displaying a result of the determination.

2. The radio-controlled watch according to claim 1, wherein the instruction receiving means receives the instruction operation from the user in a state in which the determination result display means displays that the leap second correction value stored in the storage means is not valid, and the instruction receiving means restricts the reception of the instruction operation in a state in which the determination result display means displays that the leap second correction value stored in the storage means is valid.

3. The radio-controlled watch according to claim 1, wherein:

the signal from the satellite contains information relating to the leap second correction value;

the radio-controlled watch further comprises leap second information receiving means for receiving the signal containing the information relating to the leap second correction value from the satellite, and changing the leap second correction value stored in the storage means in accordance with the received signal; and the leap second information receiving means updates the information relating to the expiry date when extracting the information relating to the leap second correction value.

4. The radio-controlled watch according to claim 1, wherein the leap second display means displays the numerical value corresponding to the leap second correction value by a combination of a second hand and a minute hand.

5. The radio-controlled watch according to claim 1, wherein:

the instruction receiving means receives, from the user, the instruction operation of changing the leap second correction value and also an input operation of information indicating an application time of applying the changed leap second correction value; and the leap second correction value changing means changes the leap second correction value stored in the storage means at a time corresponding to the application time.

6. The radio-controlled watch according to claim 1, wherein, when it is determined that the leap second correction value stored in the storage means is valid, the determination result display means displays the expiry date together with the result of the determination.

* * * * *